US005123584A

United States Patent [19]

Harrison

[11] Patent Number: 5,123,584

[45] Date of Patent: Jun. 23, 1992

[54] MULTI-POINT NAIL DRIVER SYSTEM

[76] Inventor: Martin W. Harrison, 3615 NE. 207th St.-Ste. 3210, Adventura, Fla. 33180

[21] Appl. No.: 564,534

[22] Filed: Aug. 6, 1990

[51] Int. Cl.[5] ..... B25C 3/00

[52] U.S. Cl. ..... 227/147; 81/44

[58] Field of Search ..... 227/147; 81/44; 173/91

[56] References Cited

U.S. PATENT DOCUMENTS

| | | | |
|---|---|---|---|
| 2,855,601 | 10/1958 | Hamlin | 227/147 |
| 2,973,520 | 3/1961 | Bell | 227/147 |
| 2,973,527 | 3/1961 | Maynard et al. | 227/147 |
| 3,060,440 | 10/1962 | Pfaff et al. | 227/147 |
| 4,557,409 | 12/1985 | Hecock et al. | 227/147 |
| 4,967,632 | 11/1990 | Jackson | 81/44 |

FOREIGN PATENT DOCUMENTS

| | | | |
|---|---|---|---|
| 1392574 | 2/1965 | France | 81/44 |
| 1004305 | 9/1965 | United Kingdom | 227/147 |

*Primary Examiner*—Mark Rosenbaum

*Assistant Examiner*—John M. Husar

*Attorney, Agent, or Firm*—Walter G. Finch

[57] ABSTRACT

A two-pointed nail driver system is provided for joining materials, such as planks together. The system consists of a column or sleeve used as a hammer. This column or sleeve is provided with a bore extending longitudinally lengthwise from one end of the column or sleeve but terminating short of the opposite end of the column or sleeve. A plunger element is positioned in the bore and its length extends beyond the bore and externally of the column and/or sleeve. At least one aperture is provided in the plunger element and extends lengthwise and longitudinally thereof. This aperture is arranged to receive one end of a two pointed nail having a head intermediate the ends of the two pointed nail and adjacent to the opening of the aperture. When the two-pointed nail is properly positioned, the column or sleeve can be used to strike the plunger to drive one end of the nail into a first member which is to be joined to a second member, such as planks.

4 Claims, 1 Drawing Sheet

MULTI-POINT NAIL DRIVER SYSTEM

BACKGROUND AND SUMMARY OF THE INVENTION

This invention relates to hand type tools and more particularly it pertains to implements for inserting fasteners, such as nails and the like.

THE PRIOR ART

The closest prior art U.S. patents and/or publications are as follows:

| | |
|---|---|
| 162,643 | 1,727,574 |
| 318,474 | 1,765,729 - LaMorte |
| 633,242 - Hayes | 1,767,565 - Thrift et al |
| 649,686 - Breul | 2,077,784 - Tripp |
| 759,400 | 2,231,178 - Beckwith |
| 862,189 - Olsen | 2,761,348 - Williams et al |
| 894,511 | 3,324,542 - Hilti |
| 1,354,738 | 3,403,592 - Larson |
| 1,389,540 - Washington | 3,870,428 - Jackson |
| 1,412,506 - Carter | 4,802,802 - Thurner |
| 1,561,518 - Graham | |

The patent to Hayes, U.S. Pat. No. 633,242, teaches an implement for inserting paper fastener into a plurality of sheets, with the fastener having a flat head and a pointed end, while the Breul U.S. Pat. No. 649,686 teaches a two pointed carpet staple offset from each other.

In the Olsen U.S. Pat. No. 862,189, there is shown a Pinch dog for holding a plurality of pieces of wood or the like together, while the Washington U.S. Pat. No. 1,389,540 teaches a nail staple for use with barbed wire. This staple has a body with a head, an extending point at the opposite end thereof and pointed arm extending outwardly from the body.

The Carter U.S. Pat. No. 1,412,506 teaches the use of a pointed nail, having a head for holding flooring together, while the Patent to Graham U.S. Pat. No. 1,561,518 teaches a two headed cement stucco anchor nail used for holding stucco components together, while the LaMorte U.S. Pat. No. 1,765,729 teaches a similar device or nail having two heads or at least one head and protruding arms for fireproofing of concrete.

The Thrift et al U.S. Pat. No. 1,767,565 teaches a nail having a head centrally positioned on the shaft, with a head and pointed end for use in a furring device.

The Tripp U.S. Pat. No. 2,077,784 teaches the method of manufacturing nails of a type with a head and pointed end. The Beckwith U.S. Pat. No. 2,231,178 teaches a two legged and pointed staple having a bridging member positioned adjacent the heads of the staple. The legs are used to capture barbed wire when strung between posts.

Williams U.S. Pat. No. 2,761,348 teaches a centering and guiding means for pins, studs, and other like fastening elements.

The Hilti U.S. Pat. No. 3,324,542 shows the use of a centering system for attaching a pointed nail and its attached structure to a hard object, such as concrete, while the Larson U.S. Pat. No. 3,403,592 discloses a staple having parallel arranged legs and pointed ends thereon for capturing a cylindrical and/or spherical object in the ground.

The Jackson U.S. Pat. No. 3,870,428 teaches a fastener having a flat head, pointed end, and a intermediate the head and end for use in anchoring reinforcing expansion baskets to a concrete treated base or to an asphalt mix during road construction, while U.S. Pat. No. 4,802,802 teaches an attaching unit which is made up of a nail and sleeve fitted onto the nail so that when the nail is driven into a receiving material, its head runs into and laterally deforms a second sleeve section thereon. When the nail is driven in, a nut can be placed over this second sleeve and threaded onto the exterior thread.

STATEMENT OF THE PROBLEM

In the woodworking and construction industries, in carpeting or just for handymen, there are so many times when it is necessary to hold together two pieces of material, such as wood, either permanently or just while the glue sets or while a hole and/or aperture is drilled for a bolt and/or screw. Nails, in general, hold materials fairly well. This system leaves no exposed heads or holes that have to be filled later.

THE INVENTION

A simple two-pointed nail driver system is provided for holding materials together either permanently or temporarily. This nail driver system when struck by a hammer, will hold and drive a nail that has two sharp points at either end with the head of the nail being located at the mid shaft. One of the points of the nail is driven into the material in the first instance by the hammer. This leaves exposed the second sharp point of the nail. The second point of the nail will then have material directly driven onto it.

The nail driver system is a soft-rubber-coated grip around an impact column or member and a nail sleeve. The sleeve is hollow to hold the nail as well as being reversible to hold at least two different diameters of nails, with any length of nail being easily accommodated. The sleeve may also be magnetic to help hold the nails and also may extend slightly at the end to countersink the nail head.

The nails for the system can be made in several sizes. Some of the nails could be made with a long and short ends for various purposes.

OBJECTS OF THE INVENTION

One of the objects of this invention is to provide a multi-pointed nail driver system for holding materials together either permanently or temporarily.

Still another object of this invention is to provide a multi-pointed nail driver system that is easily and inexpensively manufactured.

And still another object of this invention is to provide a multi-pointed nail driver system. That is, an economical useful tool for joining materials together.

And even another object of this invention is to provide a multi-pointed nail driver system that is efficient and reliable in operational use, and in which the maintenance thereto is at a minimum.

To provide a multi-pointed nail driver system that is easy to use in operational use, is still another object of this invention.

BRIEF DESCRIPTION OF THE DRAWINGS

These and other objects and attendant advantages of this invention will become more obvious and understood from the following detailed specification and accompanying drawings in which.

DESCRIPTION OF THE PREFERRED EMBODIMENTS

Figure 1:
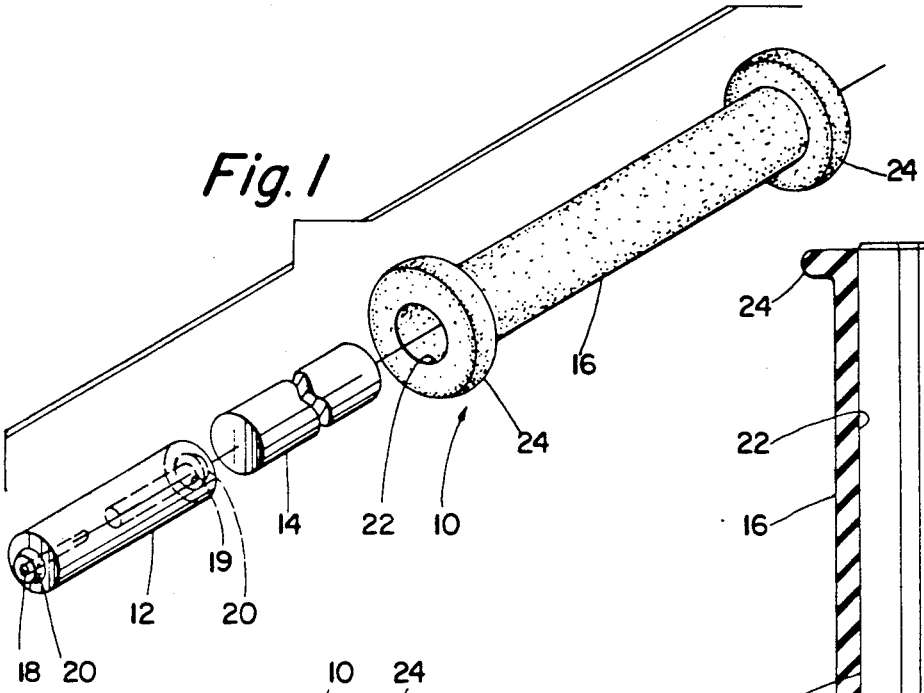
FIG. 1 is an exploded view of a two-pointed nail driver system incorporating features of this invention.
Figure 3:
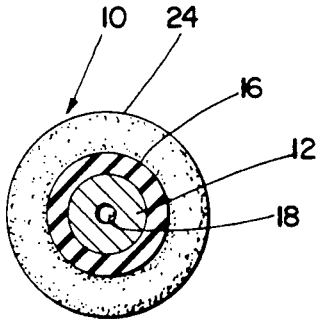
FIG. 3 is a cross section taken along line 3—3 of FIG. 2.
Figure 2:
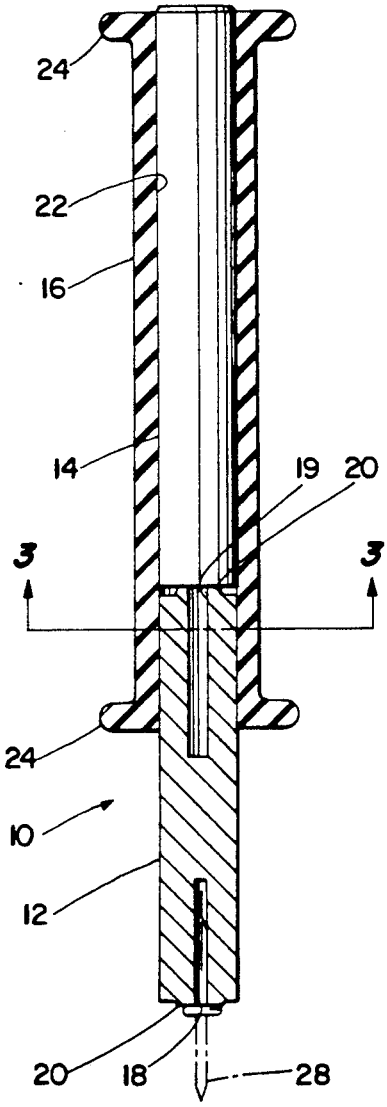
FIG. 2 is a cross section of the two-pointed nail driver system of FIG. 1 taken along the longitudinal axis thereof.

Referring now to FIGS. 1, 2 and 3 of the drawings, there is illustrated a preferred embodiment of the invention for a two-pointed (multi) nail driver system 10 consisting of a cylindrical cylinder or column (or sleeve) 16 having two enlarged cylindrical ends 24. The cylinder or column 16 is provided with a longitudinally extending bore 22 extending the length thereof.

A first solid cylindrical member 14 is inserted in the bore 22 at one end of the cylinder or column 16 and is affixed in fixed position in the cylinder or column 16. A second solid cylindrical member 12 is mounted for movement in the opposite end of the bore 22 in the cylinder or column 16.

Figure 4:
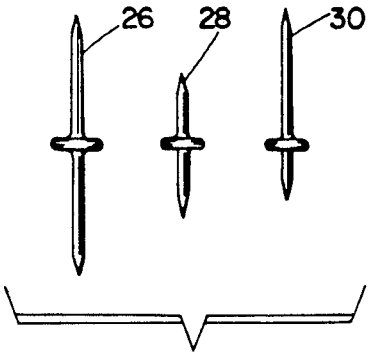
FIG. 4 is a front view of a series of two-pointed nails.

This second solid cylindrical member 12 is provided with a longitudinally extending aperture or bore 18 at each end thereof for receiving a two-pointed nail, such as 26, 28 and/or 30, shown in FIG. 4. These apertures or bores are preferably made of different diameter and lengths for nails 26, 28 and/or 30 of different sizes as shown in FIG. 4.

At each end of the second cylinder 12, there is a slight protrusion 20 to receive and seat the head of the nail 26, 28 and 30.

Referring now to FIG. 4, there is shown at least three different nails 26, 28 and 30. Nail 26 is constructed to have the head of the nail in the center, with the two-pointed ends located an equal distance from the head of the nail. Nail 28 is smaller than nail 26, but of similar design. Nail 30, on the other hand, is constructed so that the shorter end thereof is closer to the nail head than the longer end.

In summary, when the two-point nail driver system 10 is struck by a hammer when the nail 26, 28 or 30 is in operative position, it will hold and drive a nail 26, 28 or 30 that has two sharp points at either end, with the head of the nail at mid-shaft. One of the points of the nail 26, 28 or 30 is driven into the material in the first instance by the hammer and this leaves exposed the second sharp point of the nail 26, 28 or 30. The second point of the nail 26, 28 or 30 will then have material directly driven on to it. The nail driven system 10 is simply a soft, rubber-coated grip around an impact column and nail sleeve 16. The sleeve 16 is hollow to hold a nail 26, 28 or 30 and reversible to hold at least two different diameters of nails 26, 28 or 30 (any length of nail 26, 28 or 30) is easily accommodated. The sleeve 16 may also be made magnetic to help hold the nail 26, 28 or 30 and also may extend slightly at the end to countersink the nailhead.

The solid column 16 can be used for driving the various nails 26, 28 and/or 30, whether they are of the same diameters or different diameters depending upon the diameters and lengths of the apertures 18. The lengths of the apertures 18 can vary depending upon the circumstances in view of the fact a series of different size plungers 12 can be made available.

The two-pointed nail system 10 is made of steel of a medium grade. The steel of the plunger 12 has to be soft enough so that you can hit it with another piece of hard steel column 16 (hammer), but hard enough to withstand the impact (like a cold chisel). This steel is close to perfect and gives a good feel for what the final product will weigh.

When it is desired to join two materials, like the ends of two planks, these planks are placed on a flat surface or base. The two-pointed nail driver system 10 is assembled with a selected nail 26, 28 or 30 or others of desired length, positioned in the aperture 18 as shown in FIG. 2. The selected nail 26, 28 or 30 is then driven by the column 16 into the end of the plank. A serial of nails 26, 28 or 30 can be driven in a like manner. The free ends of the nails 26, 28 or 30 are then driven into the end of the other plank by placing its un-nailed end adjacent the nailed end and then either pushing or hammering the two plank ends together to join the planks as one piece.

Accordingly, modifications and variations to which the invention is susceptible may be practiced without departing from the scope and intent of the appended claims.

What is claimed is:

1. A multi-pointed nail driver system for driving nails, comprising, magnetic column means having a longitudinally extending bore with a solid cylinder therein, said solid cylinder having one end terminating at one end of said column means and the other end terminating short of the other end thereof of said column means, a second cylinder partially positioned in said bore of said column means and having a free end thereof extending outwardly of the opened end of said bore, said second cylinder being provided with parallel longitudinally extending apertures in its free end for receiving a pointed end of a two-pointed nail which is to be driven by said column means striking said second cylinder, said second cylinder, at each end, having a slight protrusion for receiving and seating the head of the pointed end of said two-pointed nail.

2. A multi-pointed nail driver system as recited in claim 1, wherein said second cylinder is provided with longitudinally extending apertures at both ends thereof.

3. A multi-pointed nail driver system as recited in claim 1, wherein said second cylinder is provided with different diameter longitudinally extending apertures at both ends thereof.

4. A multi-pointed nail driver system as recited in claim 1, wherein said second cylinder is provided with different diameter longitudinally extending apertures at both ends thereof, with the lengths of said apertures being of different measurements.

* * * * *